US010477297B2

(12) United States Patent
Tsai

(10) Patent No.: US 10,477,297 B2
(45) Date of Patent: Nov. 12, 2019

(54) CIRCUMAURAL EARPHONE

(71) Applicant: Ampacs Corporation, Taipei (TW)

(72) Inventor: Sheng-Ping Tsai, New Taipei (TW)

(73) Assignee: Ampacs Corporation, Taipei (TW)

( * ) Notice: Subject to any disclaimer, the term of this patent is extended or adjusted under 35 U.S.C. 154(b) by 18 days.

(21) Appl. No.: 15/889,206

(22) Filed: Feb. 6, 2018

(65) Prior Publication Data

US 2019/0158949 A1 May 23, 2019

(30) Foreign Application Priority Data

Nov. 21, 2017 (TW) ..... 106217237 U

(51) Int. Cl.
*H04R 1/10* (2006.01)

(52) U.S. Cl.
CPC ..... *H04R 1/1066* (2013.01); *H04R 1/105* (2013.01); *H04R 1/1008* (2013.01)

(58) Field of Classification Search
None
See application file for complete search history.

(56) References Cited

U.S. PATENT DOCUMENTS 4,484,029 A * 11/1984 Kenney ..... H04M 1/6066 379/430
5,649,309 A * 7/1997 Wilcox ..... H04M 1/0216 455/575.3
6,427,018 B1 * 7/2002 Keliiliki ..... H04R 1/1066 381/370
6,768,804 B1 * 7/2004 Isvan ..... H04R 1/083 181/20
7,027,294 B2 * 4/2006 Kato ..... G06F 1/1616 361/679.08
8,121,334 B2 * 2/2012 Tsai ..... H04M 1/05 381/374
8,559,665 B2 10/2013 Schmidt et al.
8,777,020 B2 * 7/2014 Winig ..... A47F 7/0243 211/7
8,872,053 B2 * 10/2014 Wittenberg ..... H01H 15/102 200/329

(Continued)

FOREIGN PATENT DOCUMENTS

CN 205142456 4/2016
TW M482915 7/2014

OTHER PUBLICATIONS

Hifi Heaven, "Master and Dynamic MH40 Review—Most Dynamic Headphone Under $400?." 0:00-12:11. May 22, 2016. https://www.youtube.com/watch?v=AK_Re_oGJfA.*

(Continued)

*Primary Examiner* — Qin Zhu
(74) *Attorney, Agent, or Firm* — JCIPRNET

(57) ABSTRACT

A circumaural earphone including a headband, an adjustment mechanism, a rod, and an earphone module assembled to the rod is provided. The adjustment mechanism disposed at an end of the headband includes a housing and a pivoting ring assembled in the housing to be rotatable about an axis relative to the housing. The rod is disposed rotatably through the pivoting ring and the housing along the axis, wherein the rod and the pivoting ring are adapted to each other structurally for the rod to drive the pivoting ring to rotate about the axis synchronously. The earphone module is disposed on the rod.

11 Claims, 5 Drawing Sheets

(56) References Cited

U.S. PATENT DOCUMENTS

| | | | | |
|---|---|---|---|---|
| 9,031,275 | B2 * | 5/2015 | Brodsgaard | H04R 1/105 381/370 |
| 9,402,125 | B2 * | 7/2016 | Davie | H04R 1/105 |
| 9,469,194 | B2 * | 10/2016 | Sockolosky | B60K 35/00 |
| 9,521,478 | B2 * | 12/2016 | Jiang | H04R 1/105 |
| 9,609,415 | B2 * | 3/2017 | Taylor | H04R 1/1066 |
| 10,027,080 | B2 * | 7/2018 | Solland | H01R 31/06 |
| 10,129,632 | B2 * | 11/2018 | Chute | H04R 1/1008 |
| 10,136,210 | B2 * | 11/2018 | Blair | H04R 1/105 |
| 10,156,735 | B2 * | 12/2018 | Johnson | G02C 5/2263 |
| 10,187,718 | B2 * | 1/2019 | Andrikowich | H04R 1/105 |
| 2005/0120515 | A1 * | 6/2005 | Kato | G06F 1/1616 16/221 |
| 2011/0129111 | A1 * | 6/2011 | Santiago | H04R 5/0335 381/379 |
| 2012/0052924 | A1 * | 3/2012 | Cybart | H04M 1/05 455/569.1 |
| 2018/0220224 | A1 * | 8/2018 | Chute | H04R 1/1066 |

OTHER PUBLICATIONS

Collins, Danielle. "Transmitting torque with keyed shafts." pp. 1-10. Nov. 13, 2015. https://www.linearmotiontips.com/transmitting-torque-with-keyed-shafts/.*

Fallon, Brian. "Arctis: designed like no other." pp. 1-13. Jun. 19, 2017. https://steelseries.com/blog/arctis-designed-like-no-other-7.*

* cited by examiner

CIRCUMAURAL EARPHONE

CROSS-REFERENCE TO RELATED APPLICATION

This application claims the priority benefit of Taiwan application serial no. 106217237, filed on Nov. 21, 2017. The entirety of the above-mentioned patent application is hereby incorporated by reference herein and made a part of this specification.

BACKGROUND OF THE INVENTION

Field of the Invention

The invention relates to a circumaural earphone.

Description of Related Art

Now many circumaural earphone products are provided with various adjustment mechanisms for the users to adjust the headband or earphone to fit the users' heads and suit their usage habits.

Such adjustment mechanisms however may increase the sizes and make it difficult to carry or put the circumaural earphones in the bags, etc. The adjustment mechanisms would also complicate the production and assembly processes and may easily result in problems such as wear of the parts.

Therefore, how to improve the convenience and functionality with a simple structural configuration is an issue that needs to be addressed in this field.

SUMMARY OF THE INVENTION

The invention provides a circumaural earphone, which improves the convenience in use with a simple structure.

A circumaural earphone according to an embodiment of the invention includes a headband, an adjustment mechanism, a rod, and an earphone module. The adjustment mechanism is disposed at an end of the headband. The adjustment mechanism includes a housing and a pivoting ring, wherein the pivoting ring is assembled in the housing to be rotatable about an axis. The rod is disposed through the pivoting ring and the housing to be slidable along the axis, and the rod and the pivoting ring are adapted to each other structurally for the rod to drive the pivoting ring to rotate about the axis synchronously. The earphone module is assembled to the rod.

In an embodiment of the invention, an inner surface of the pivoting ring has a first adapter portion and an outer surface of the rod has a second adapter portion. When the rod is disposed through the pivoting ring, the first adapter portion and the second adapter portion are closely in contact with each other without a gap. The first adapter portion and the second adapter portion are movable relative to each other along the axis without being blocked, and the first adapter portion and the second adapter portion interfere with each other in a rotation direction about the axis.

In an embodiment of the invention, the first adapter portion is a protruding structure or a recessed structure and the second adapter portion is a recessed structure or a protruding structure.

In an embodiment of the invention, the first adapter portion is a tangential plane structure on the inner surface of the pivoting ring, and the second adapter portion is a tangential plane structure on the outer surface of the rod.

In an embodiment of the invention, the first adapter portion and the second adapter portion respectively extend along the axis.

In an embodiment of the invention, the rod further includes a pair of first stoppers located at opposite two ends of the second adapter portion along the axis.

In an embodiment of the invention, the first stopper is a stage structure or a tilt structure located at an end of the second adapter portion.

In an embodiment of the invention, the circumaural earphone further includes a sleeve member disposed on an end of the rod to form the stage structure.

In an embodiment of the invention, the outer surface of the pivoting ring has a protrusion, such that when the pivoting ring rotates about the axis relative to the housing, the protrusion interferes with at least a second stopper of the housing.

In an embodiment of the invention, the circumaural earphone further includes at least a first retainer disposed in the housing and located beside the pivoting ring. The rod is disposed through the first retainer to be slidable, such that the first retainer provides friction to the rod.

In an embodiment of the invention, the circumaural earphone further includes a second retainer disposed between the pivoting ring and the housing. The second retainer provides friction to the pivoting ring along the axis.

In an embodiment of the invention, the rod has a yoke contour, which includes a straight section and a bent section, wherein the second adapter portion is located in the straight section and the earphone module is assembled to the bent section and is consistent with a contour of the bent section.

Based on the above, in the circumaural earphone, the pivoting ring is disposed to be rotatable about the axis but not slidable in the housing of the adjustment mechanism, and the rod is disposed through the pivoting ring of the adjustment mechanism. Moreover, the rod and the pivoting ring are adapted to each other structurally, such that the rod may slide relative to the adjustment mechanism without driving the pivoting ring, and the rod drives the pivoting ring to rotate synchronously when the rod rotates about the axis. In other words, the driving relationship between the rod and (the pivoting ring of) the adjustment mechanism remains in one direction. Thus, the coordination of the rod and the pivoting ring allows the rod to move in different directions but allows the pivoting ring of the adjustment mechanism to be driven in one of the directions, not in the other. Therefore, the corresponding relationship and movement pattern between the earphone module and the headband are achieved with the simple structural configuration as described above.

To make the aforementioned and other features and advantages of the invention more comprehensible, several embodiments accompanied with drawings are described in detail as follows.

BRIEF DESCRIPTION OF THE DRAWINGS

The accompanying drawings are included to provide a further understanding of the invention, and are incorporated in and constitute a part of this specification. The drawings illustrate exemplary embodiments of the invention and, together with the description, serve to explain the principles of the invention.

DESCRIPTION OF THE EMBODIMENTS

Figure 1:
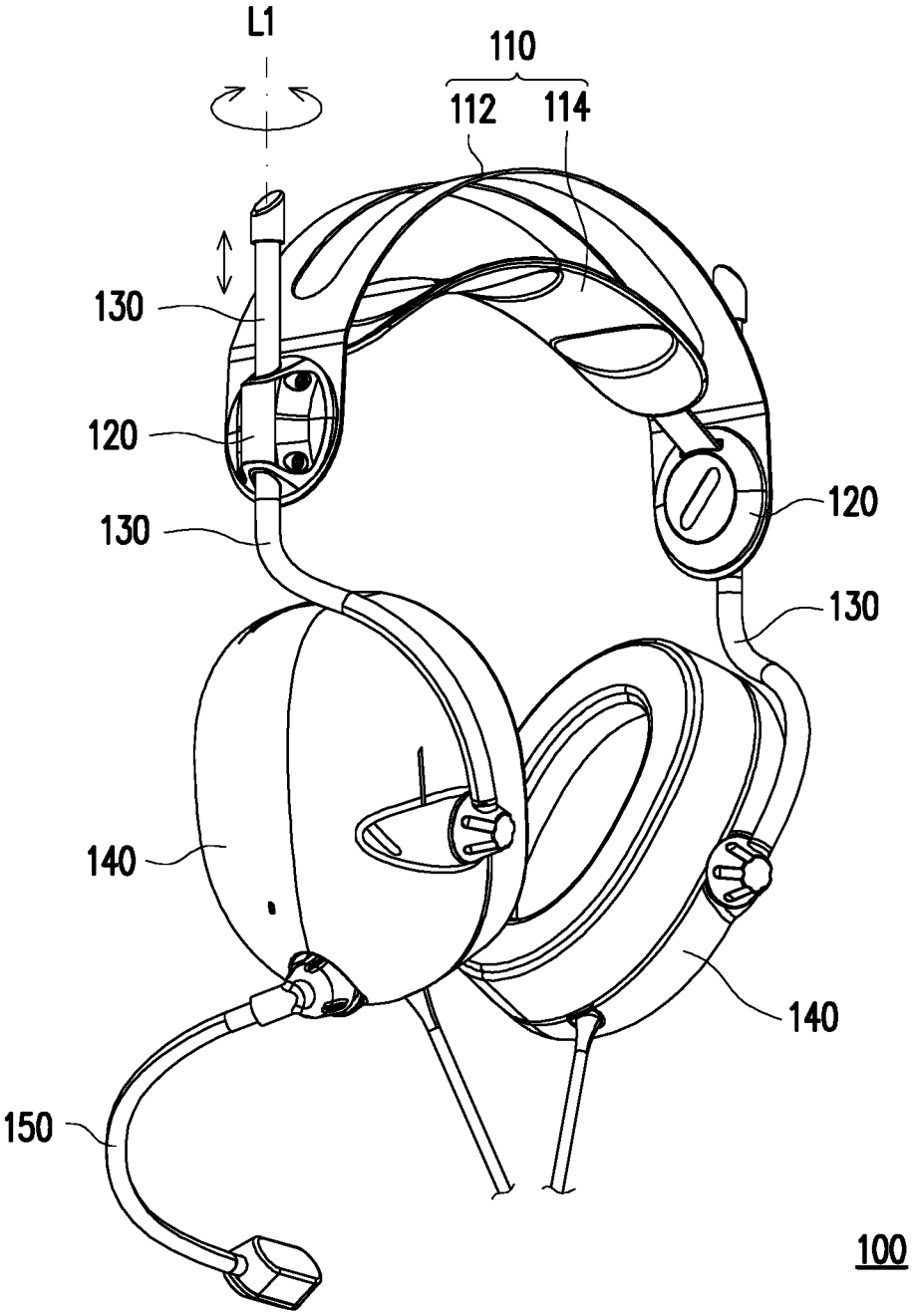
FIG. 1 is a schematic view of the circumaural earphone according to an embodiment of the invention.
Figure 2:
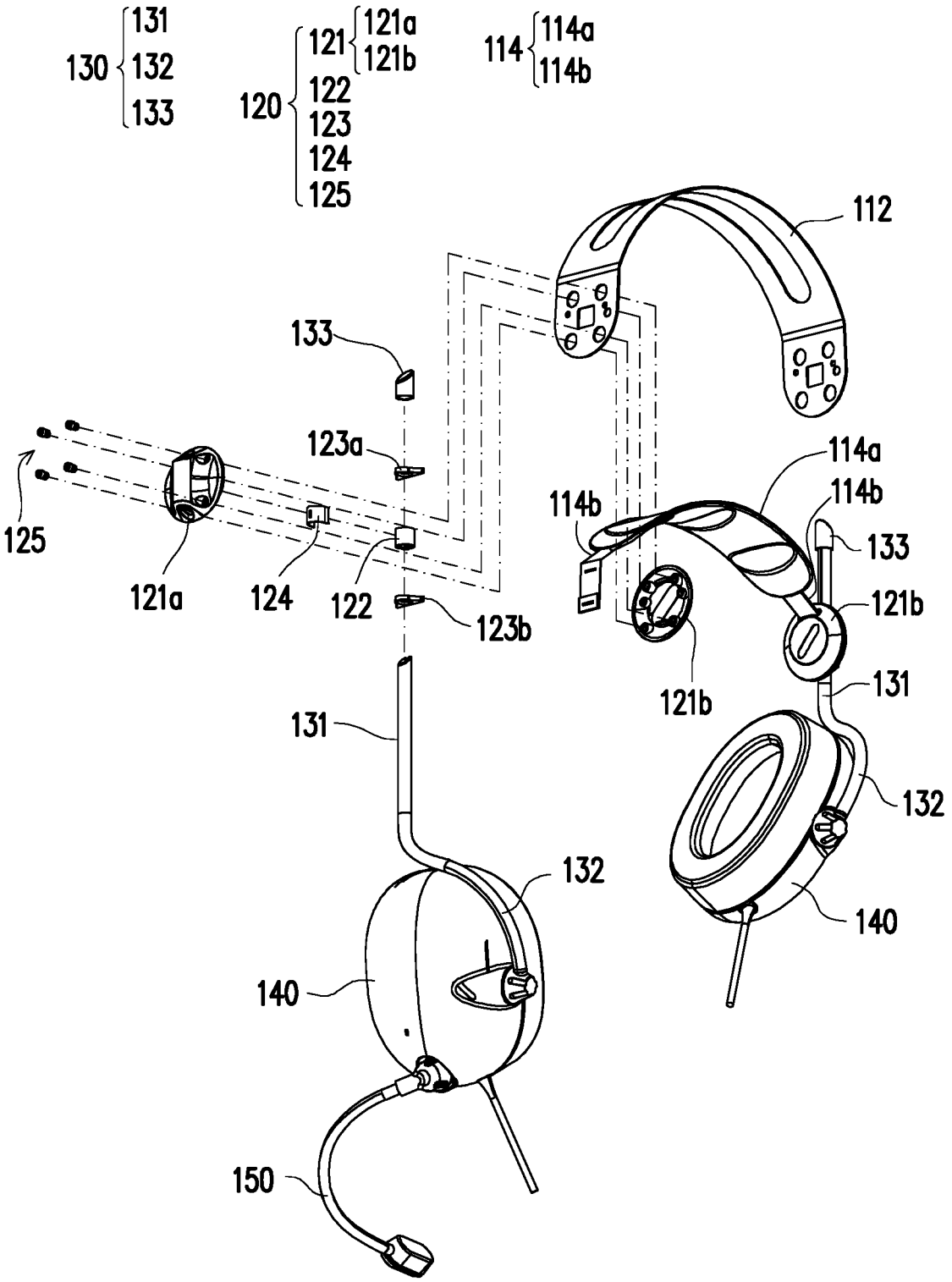
FIG. 2 is a schematic exploded view of part of the components of the circumaural earphone of FIG. 1.

FIG. 1 is a schematic view of a circumaural earphone according to an embodiment of the invention. FIG. 2 is a schematic exploded view of part of the components of the circumaural earphone of FIG. 1. Referring to FIG. 1 and FIG. 2, in this embodiment, the circumaural earphone 100 includes a headband 110, an adjustment mechanism 120, a rod 130, an earphone module 140, and a microphone module 150, wherein the adjustment mechanism 120 is respectively disposed at opposite two ends of the headband 110. The headband 110 includes a main band 112 and a tether band 114, wherein the tether band 114 may be stretched and adjusted to fit a head shape of a user. As shown in FIG. 2, the tether band 114 includes a main body 114*a* and an adjustment band 114*b*. The adjustment band 114*b* is connected to a case 121*b* and is movable (deformable) relative to the main body 114*a*, so as to adjust a relative distance between the case 121*b* and the main body 114*a*, wherein in an embodiment, the adjustment band 114*b* is an elastic band to be stretched and adjusted according to the user's needs. The rod 130 is disposed through and assembled to the adjustment mechanism 120 to achieve a movement pattern, which allows the rod 130 to slide along an axis L1 and rotate about the axis L1 relative to the headband 110. The earphone module 140 is assembled to a side of the rod 130 that is away from the headband 110, and the microphone module 150 is assembled to the earphone module 140 and performs transmission of electrical signals with other devices via a cable (as shown) to achieve effects of playing and receiving sounds. Accordingly, through adjustment of the rod 130 and the adjustment mechanism 120, the earphone module 140 and the microphone module 150 may be in different states with respect to the headband 110. Details of the earphone module 140 and the microphone module 150 may be understood from the related art and thus are not repeated hereinafter.

It should be noted that, since the components of the circumaural earphone 100 are designed to be symmetrical, FIG. 2 and the following descriptions are based on the components on one side, and the components on the other side have the same configuration and thus details thereof are not repeated hereinafter.

Figure 3A:
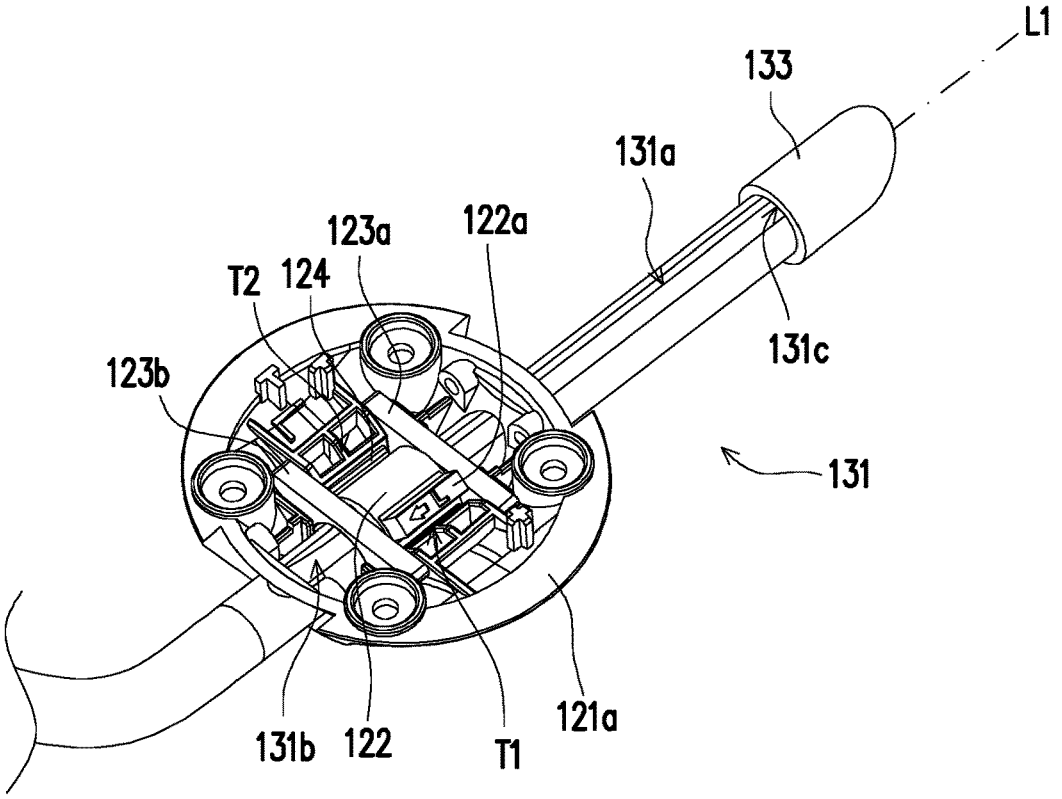
FIG. 3A and FIG. 3B are partial schematic views of the adjustment mechanism and the rod.
Figure 3B:
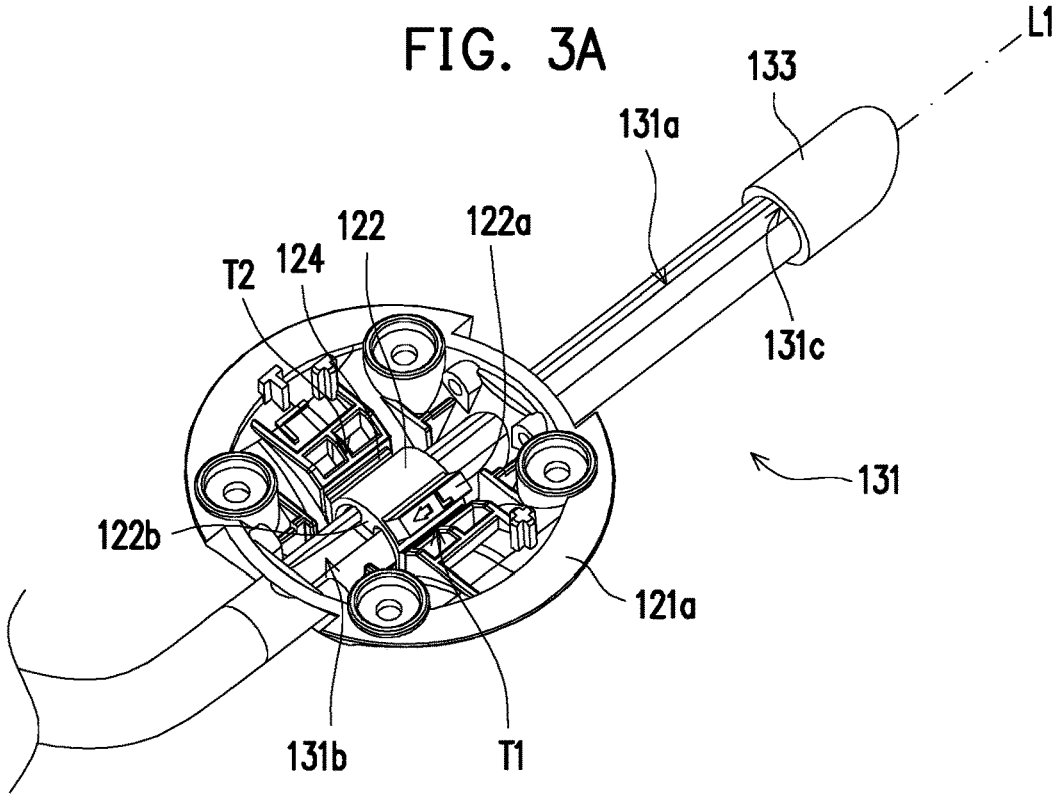

Referring to FIG. 2, in this embodiment, the adjustment mechanism 120 includes a housing 121, a pivoting ring 122, first retainers 123*a* and 123*b*, and a second retainer 124, wherein the housing 121 is formed by connecting two cases 121*a* and 121*b* and combined together by fastening parts 125. FIG. 3A and FIG. 3B are partial schematic views of the adjustment mechanism and the rod. In FIG. 3B, the first retainers 123*a* and 123*b* shown in FIG. 3A are omitted to clearly illustrate the relationship between the rod 130 and the pivoting ring 122. Referring to FIG. 2, FIG. 3A, and FIG. 3B, the pivoting ring 122 is assembled in the case 121*a* of the housing 121 and is rotatable about the axis L1. The rod 130 includes a straight section 131 and a bent section 132, wherein the straight section 131 is disposed through the housing 121, the first retainers 123*a* and 123*b*, and the pivoting ring 122 to be slidable along the axis L1, and the earphone module 140 is assembled to the bent section 132. A partial contour of the earphone module 140 is consistent with a contour of the bent section 132, as shown in FIG. 1, and a pair of the rods 130 of the circumaural earphone 100 substantially presents a yoke contour respectively.

Figure 4A:
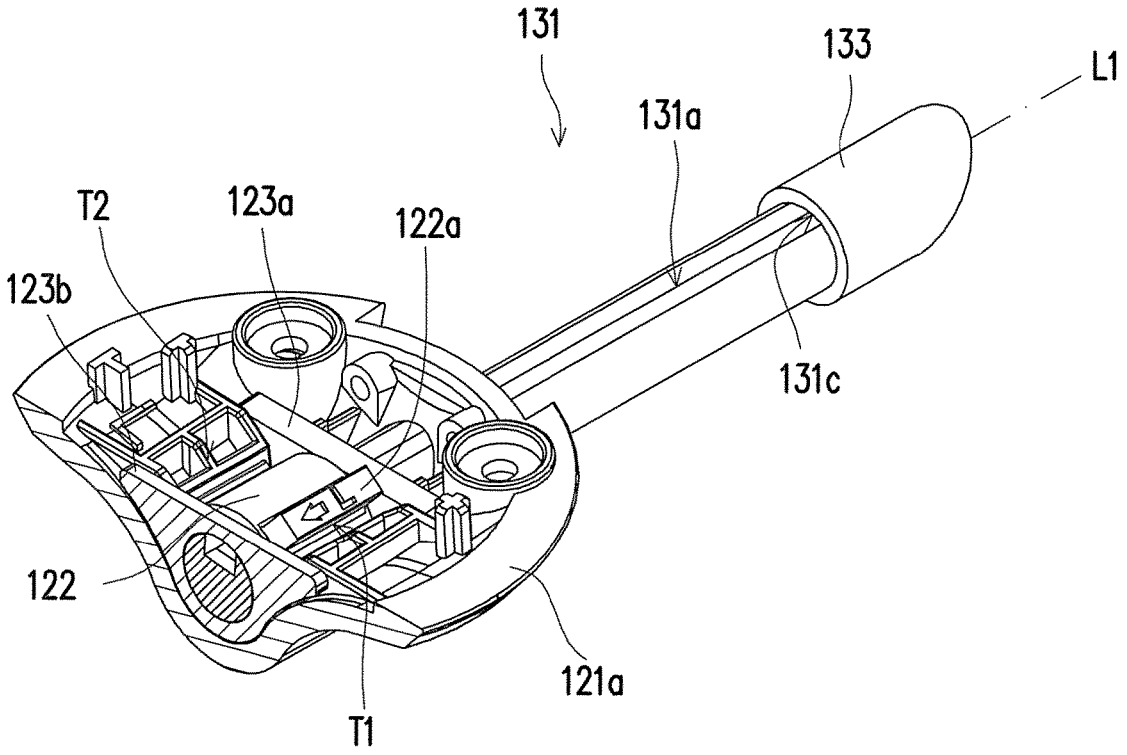
FIG. 4A and FIG. 4B are partial schematic cross-sectional views of the adjustment mechanism and the rod.
Figure 4B:
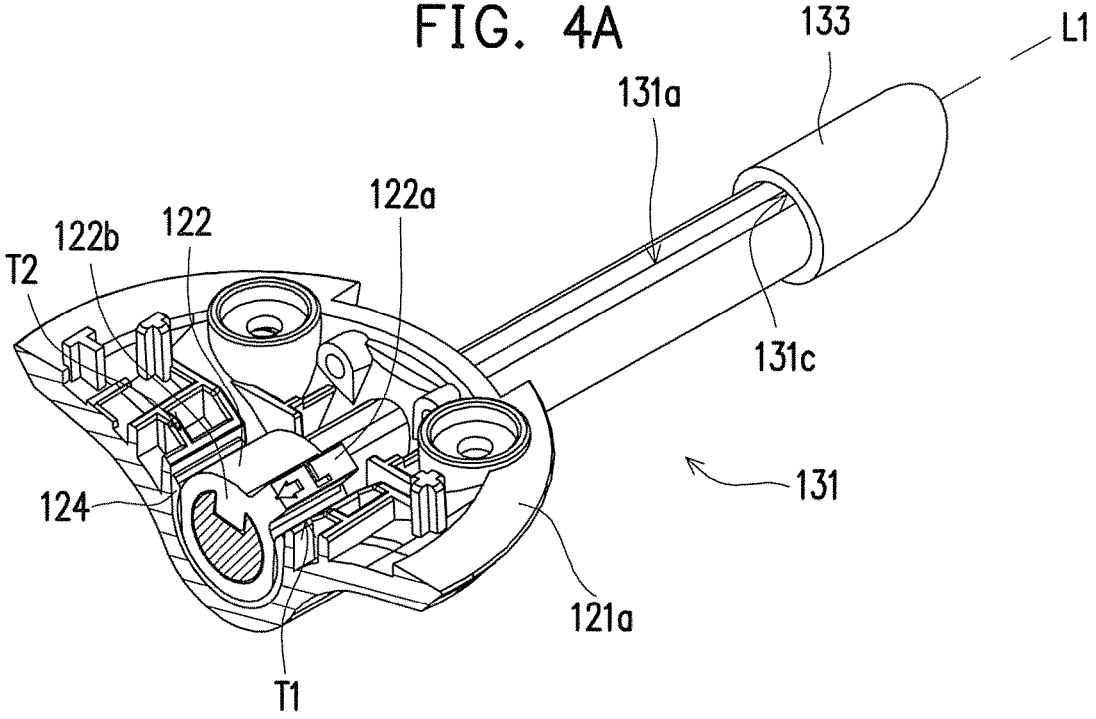

FIG. 4A and FIG. 4B are partial schematic cross-sectional views of the adjustment mechanism and the rod. Likewise, the first retainers 123*a* and 123*b* shown in FIG. 4A are omitted from FIG. 4B. Please refer to FIG. 3A, FIG. 3B, FIG. 4A, and FIG. 4B.

It should be noted that the rod 130 and the pivoting ring 122 are adapted to each other structurally for the rod 130 to drive the pivoting ring 122 to rotate synchronously about the axis L1. Specifically, as shown in FIG. 3B, an inner surface of the pivoting ring 122 has a first adapter portion 122*b*, which is a protruding structure for example, and an outer surface of the rod 130 has a second adapter portion 131*a*, which is a recessed structure extending along the axis L1 for example. Thus, when the rod 130 is disposed through the pivoting ring 122, the first adapter portion 122*b* and the second adapter portion 131*a* are closely in contact with each other without a gap. As a result, the first adapter portion 122*b* and the second adapter portion 131*a* are movable relative to each other along the axis L1 without being blocked (because the first adapter portion 122*b* and the second adapter portion 131*a* both extend along the axis L1), and the first adapter portion 122*b* and the second adapter portion 131*a* interfere with each other in a rotation direction about the axis L1.

Here, "being adapted to each other structurally" refers to a state where two components abut each other closely with no gap between the structures, resulting in a particular driving relationship between the two components. In this embodiment, since the protruding structure (the first adapter portion 122*b*) of the pivoting ring 122 is allowed to slide back and forth along the axis L1 in the recessed structure (the second adapter portion 131*a*) of the rod 130 without being hindered, and when the rod 130 rotates about the axis L1 relative to the adjustment mechanism 120, the rod 130 constantly drives the pivoting ring 122 to rotate about the axis L1 in the housing 121, the particular driving relationship is established, and furthermore, movement patterns of the rod 130 in different directions correspond to different contact structures on the adjustment mechanism 120. In other words, when the rod 130 slides along the axis L1, the contact structures are the inner surface of the pivoting ring 122 and the outer surface of the rod 130; and when the rod 130 rotates about the axis L1, the contact structures change to the outer surface of the pivoting ring 122 and the inner surface of the housing 121 (the case 121*a*). Thus, by providing the rod 130, the pivoting ring 122, and the housing 121 with different friction coefficients, the corresponding relationship between the rod 130 and the headband 110 may be adjusted, and thereby the user may have different feels in operation.

The above is not intended to limit the contours/shapes of the first adapter portion and the second adapter portion. In another embodiment not shown here, the first adapter portion may be a recessed structure and the second adapter portion may be a protruding structure.

In addition, the rod 130 further has a pair of first stoppers 131*b* and 131*c* located at two opposite ends of the second adapter portion 131*a* along the axis L1, wherein the first stopper 131*b* is located on a movement path of the first adapter portion 122*b* and the first stopper 131*c* is located on a movement path of the housing 121. Specifically, the first stopper 131*b* is a tilt structure located at one end of the second adapter portion 131*a*. Thus, when the straight section 131 of the rod 130 slides along the axis L1 relative to the pivoting ring 122, the first adapter portion 122*b* interferes with the first stopper 131*b* to be stopped. Correspondingly, the first stopper 131*c* is a stage structure located at the other end of the second adapter portion 131*a*. Specifically, the rod 130 of this embodiment further includes a sleeve member 133 disposed on one end of the straight section 131 that is away from the bent section 132 to form the stage structure, so as to interfere with the case 121*a* of the housing 121 to stop and limit the position of the case 121*a* as well as prevent the rod 130 from coming off the adjustment mechanism 120.

Moreover, the outer surface of the pivoting ring 122 has a protrusion 122*a* thereon, such that when the pivoting ring 122 rotates about the axis L1 relative to the housing 121, the protrusion 122*a* rotates to a specific position to interfere with at least one second stopper of the housing 121. Here, a pair of second stoppers T1 and T2 is provided on an inner wall of the case 121*a* as an example, which falls on the movement path of the protrusion 122*a* to serve as a limiting/positioning structure for the protrusion 122*a*.

Further, referring to FIG. 3A and FIG. 4A, the first retainers 123*a* and 123*b* of this embodiment are disposed in the housing 121 and located beside the pivoting ring 122. The rod is slidably disposed through the first retainers 123*a* and 123*b*, and the first retainers 123*a* and 123*b* are formed of rubber and thus may provide friction when the rod 130 slides, which not only responds to the user's hand as the user moves the rod 130 but also prevents the rod 130 and the housing 121 from becoming loose due to a gap in the assembly.

Moreover, referring to FIG. 2, FIG. 3B, and FIG. 4B, in this embodiment, the second retainer 124 of the circumaural earphone 100 is disposed between the pivoting ring 122 and (the case 121*a* of) the housing 121 and is formed of rubber as well, which provides friction when the pivoting ring 122 rotates about the axis L1, so as to prevent the pivoting ring 122 from coming off the case 121*a*.

Figure 5:
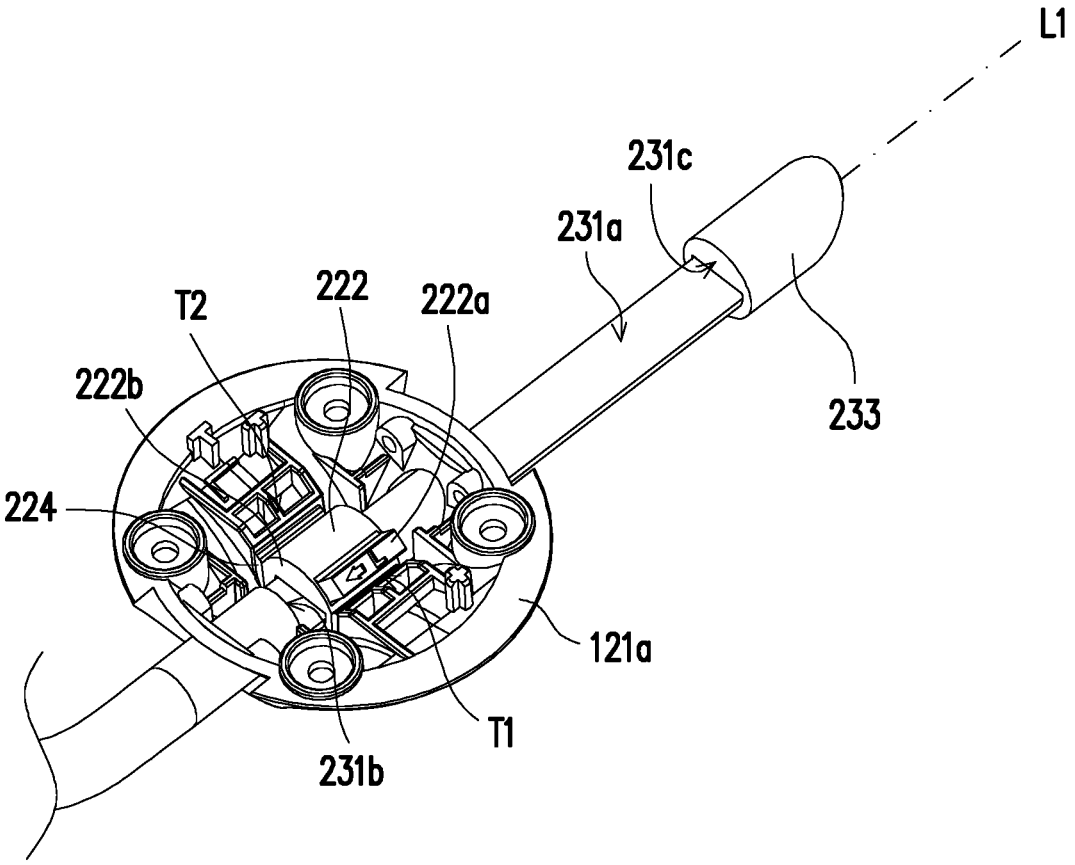
FIG. 5 is a partial schematic view of the adjustment mechanism and the rod according to another embodiment of the invention.

FIG. 5 is a partial schematic view of the adjustment mechanism and the rod according to another embodiment of the invention. A difference between this embodiment and the previous embodiment is that, in this embodiment, the second adapter portion 231*a* disposed on the rod is a tangential plane structure on the outer surface of the rod and the first adapter portion 222*b* of the pivoting ring 222 is a tangential plane structure on the inner surface thereof. The tangential plane structure is shaped like a "D" tilted sideway, for example, to be structurally adapted to each other. In other words, the rod and the pivoting ring 222 are allowed to slide relative to each other smoothly along the axis L1, and interfere with each other to drive each other when rotating about the axis L1. Correspondingly, the first stopper 231 disposed at one end of the second adapter portion 222*b* of the rod forms a stage structure at this portion of the rod for stopping the first adapter portion 222*b*, and the first stopper 231*c* at the other end is like the first stopper 131*c* as described in the previous embodiment and is formed by the sleeve member 233 combined with the straight section of the rod and has the same contour as the first adapter portion 222*b* of the pivoting ring 222. The case 121*a*, the second stoppers T1 and T2, the protrusion 222*a* on the outer surface of the pivoting ring 222, and the second retainer 224 of this embodiment are the same as those of the previous embodiment and thus details thereof are not repeated hereinafter.

To sum up, in the circumaural earphone of the above-described embodiments of the invention, the layered configuration of the rod corresponding to the components, such as the pivoting ring and carriers, of the adjustment structure allows the rod to have two movement patterns, i.e., sliding along one single axis and rotating about the one single axis, which respectively correspond to different contact structures. Therefore, by adjusting different features of the contact structures, the two movement patterns may be controlled respectively without affecting each other. In other words, when the rod slides along the axis, the contact structures are the rod and the inner surface of the pivoting ring, and therefore, the predetermined interference between the pivoting ring and the housing may be maintained without affecting the slide; or when the rod rotates about the axis, the contact structures are the outer surface of the pivoting ring and the housing, and therefore, the contact structures between the rod and the pivoting ring do not affect the rotation.

Furthermore, in the circumaural earphone, the pivoting ring is disposed to be rotatable about the axis but not slidable in the housing of the adjustment mechanism, and the rod is disposed through the pivoting ring of the adjustment mechanism. Moreover, the rod and the pivoting ring are adapted to each other structurally, such that the rod may slide relative to the adjustment mechanism without driving the pivoting ring, and the rod drives the pivoting ring to rotate synchronously when the rod rotates about the axis. Thus, the coordination of the rod and the pivoting ring allows the rod to move in different directions but allows the pivoting ring of the adjustment mechanism to be driven only in one of the directions, not in the other. Therefore, the corresponding relationship and movement pattern between the earphone module and the headband are achieved with the simple structural configuration as described above, and they do not affect each other.

Although the invention has been described with reference to the embodiments thereof, it will be apparent to one of the ordinary skills in the art that modifications to the described embodiments may be made without departing from the spirit of the invention. Accordingly, the scope of the invention will be defined by the attached claims not by the above detailed description.

What is claimed is:

1. A circumaural earphone, comprising:

a headband;

an adjustment mechanism disposed at an end of the headband and comprising:

a housing;

a pivoting ring assembled in the housing to be rotatable about an axis;

a rod disposed through the pivoting ring and the housing to be slidable along and rotatable about the axis, wherein the rod and the pivoting ring are adapted to each other structurally for the rod to drive the pivoting ring to rotate about the axis synchronously; and an earphone module assembled to the rod, wherein an inner surface of the pivoting ring has a first adapter portion and an outer surface of the rod has a second adapter portion, wherein when the rod is disposed through the pivoting ring, the first adapter portion and the second adapter portion are closely in contact with each other without a gap, and the first adapter portion and the second adapter portion are movable relative to each other along the axis without being blocked, and the first adapter portion and the second adapter portion interfere with each other in a rotation direction about the axis, wherein the rod contacts the inner surface of the pivoting ring when the rod slides along the axis, and an outer surface of the pivoting ring contacts the housing when the rod rotates about the axis.

2. The circumaural earphone according to claim 1, wherein the first adapter portion is a protruding structure or a recessed structure and the second adapter portion is a recessed structure or a protruding structure.

3. The circumaural earphone according to claim 1, wherein the first adapter portion is a tangential plane structure on the inner surface of the pivoting ring, and the second adapter portion is a tangential plane structure on the outer surface of the rod.

4. The circumaural earphone according to claim 1, wherein the first adapter portion and the second adapter portion respectively extend along the axis.

5. The circumaural earphone according to claim 4, wherein the rod further comprises a pair of first stoppers located at opposite two ends of the second adapter portion along the axis, and the pair of first stoppers is located on a movement path of the first adapter portion or the housing.

6. The circumaural earphone according to claim 5, wherein the first stopper is a stage structure or a tilt structure located at an end of the second adapter portion.

7. The circumaural earphone according to claim 6, further comprising a sleeve member disposed on an end of the rod to form the stage structure.

8. The circumaural earphone according to claim 1, wherein the outer surface of the pivoting ring has a protrusion, such that when the pivoting ring rotates about the axis relative to the housing, the protrusion interferes with at least a second stopper of the housing.

9. The circumaural earphone according to claim 1, further comprising:

at least a first retainer disposed in the housing and located beside the pivoting ring, wherein the rod is disposed through the first retainer to be slidable, such that the first retainer provides friction to the rod.

10. The circumaural earphone according to claim 1, further comprising:

a second retainer disposed between the pivoting ring and the housing, wherein the second retainer provides friction to the pivoting ring along the axis.

11. The circumaural earphone according to claim 1, wherein the rod has a yoke contour, which comprises a straight section and a bent section, wherein the second adapter portion is located in the straight section and the earphone module is assembled to the bent section and is consistent with a contour of the bent section.

* * * * *